United States Patent [19]

Sawada et al.

[11] Patent Number: 4,653,452

[45] Date of Patent: Mar. 31, 1987

[54] METHOD AND APPARATUS FOR CONTROLLING FUEL SUPPLY OF INTERNAL COMBUSTION ENGINE

[75] Inventors: Hiroshi Sawada, Gotenba; Masahiro Urushidani, Toyota, both of Japan

[73] Assignee: Toyota Jidosha Kabushiki Kaisha, Aichi, Japan

[21] Appl. No.: 694,324

[22] Filed: Jan. 24, 1985

[30] Foreign Application Priority Data

Oct. 24, 1984 [JP] Japan ..... 59-222257

[51] Int. Cl.[4] ..... F02N 17/00

[52] U.S. Cl. ..... 123/491; 123/179 L

[58] Field of Search ..... 123/179 L, 179 G, 491

[56] References Cited

U.S. PATENT DOCUMENTS

| | | | |
|---|---|---|---|
| 4,266,521 | 5/1981 | Nakano et al. | 123/179 |
| 4,399,792 | 8/1983 | Otsuka | 123/491 |
| 4,432,325 | 2/1984 | Auracher | 123/491 |
| 4,436,073 | 3/1984 | Miyagi | 123/491 |
| 4,437,445 | 3/1984 | Takahashi | 123/491 |
| 4,444,173 | 4/1984 | Yamato | 123/491 |
| 4,469,072 | 9/1984 | Kobayashi | 123/491 |
| 4,478,194 | 10/1984 | Yamato | 123/491 |
| 4,491,922 | 1/1985 | Kobayashi | 123/491 |
| 4,519,355 | 5/1985 | Fujimura | 123/491 |

*Primary Examiner*—Ronald B. Cox

*Attorney, Agent, or Firm*—Parkhurst & Oliff

[57] ABSTRACT

The fuel supply amount to an engine is gradually decreased directly after engine startup from a startup fuel supply to an after-startup fuel supply.

6 Claims, 11 Drawing Figures

METHOD AND APPARATUS FOR CONTROLLING FUEL SUPPLY OF INTERNAL COMBUSTION ENGINE

FIELD OF THE INVENTION

The present invention relates to a method and apparatus for controlling the fuel supply of an internal combustion engine, more particularly to a method and apparatus for appropriately controlling the fuel supply directly after startup.

DESCRIPTION OF THE RELATED ART

The supply of fuel at engine startup and after startup has been controlled conventionally, at startup, by setting the fuel supply to a fixed value determined by the cooling water temperature, etc. at that time and, after startup, by either calculating and controlling the fuel supply in accordance with the running state or by calculating the fuel supply in accordance with both the startup and post-startup running states.

However, with the prior art techniques, it was difficult to meet both the demands for a rich air-fuel ratio at startup and the air-fuel ratio required for stable combustion after startup. In particular, there were many problems with the short period just after startup (period of several dozen revolutions of the engine directly after startup). Specifically, the air-fuel ratio was either too rich, leading to an increase in toxic exhaust gas, or was too lean, leading to unstable engine revolution or an increase in the generation of exhaust due to noncombustion. Further, sudden changes in the air-fuel ratio upon the transition from startup to normal running would lead to unstable combustion and generate sudden changes in torque, giving an unpleasant feeling and, in the worst case, was liable to invite engine stalling. Further, the starting characteristics clearly deteriorated.

SUMMARY OF THE INVENTION

It is, therefore, an object of the present invention to provide a fuel supply control method and apparatus whereby the combustion directly after startup can be stabilized and startup characteristics can be improved.

Another object is to provide a fuel supply control method and apparatus whereby toxic exhaust gases can be reduced.

A further object is to provide a fuel supply control method and apparatus whereby no sudden changes in the torque can be expected and no unpleasant feeling due to torque shock can be caused.

According to the present invention, the amount of fuel supply directly after engine startup is gradually decreased from the determined startup fuel supply to the determined after-startup fuel supply.

DESCRIPTION OF THE PREFERRED EMBODIMENTS

Figure 1:
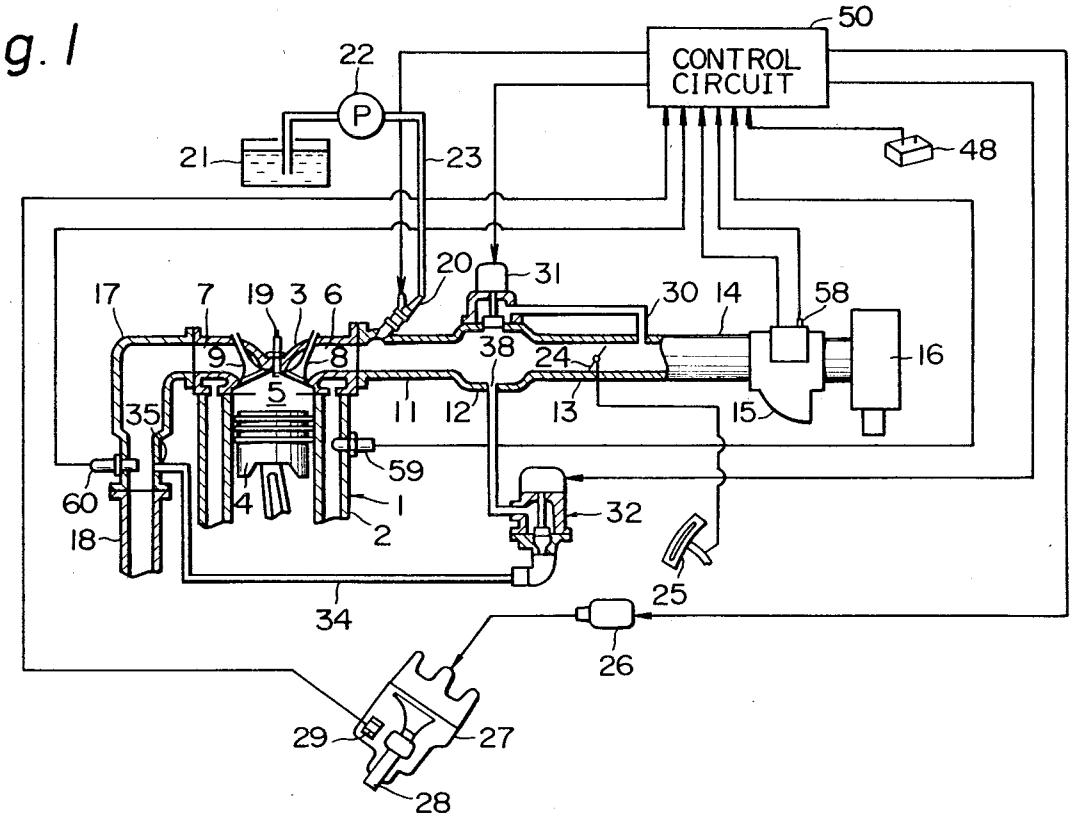
FIG. 1 is a schematic view of an embodiment of the present invention.

FIG. 1 is a schematic constitutional view of an embodiment of a gasoline engine in which the control apparatus for supply fuel according to the present invention is incorporated. In the figure, reference numeral 1 indicates the engine body, said engine 1 having a cylinder block 2 and cylinder heads 3. The cylinder block 2 is provided with pistons 4 at cylinder bores formed therein. Above the pistons 4 are formed combustion chambers 5 cooperating with said cylinder heads.

The cylinder heads 3 are formed with intake ports 6 and exhaust ports 7. These ports are designed to be opened and closed by intake valves 8 and exhaust valves 9, respectively. Further, the cylinder heads 3 are mounted with spark plugs 19. The spark plugs 19 are supplied with current generated by ignition coils 26 via a distributor 26 and generate sparks by electric discharge within the combustion chambers 5.

The intake ports 6 are connected, in succession, with an intake manifold 11, surge tank 12, throttle body 13, intake tube 14, air flow meter 15, and air cleaner 16. The engine intake system further has provided within it an air bypass passage 30 connecting the intake tube 14 and the surge tank 12 bypassing the throttle body 13. The air bypass passage 30 is opened and closed and controlled in degree of opening by a solenoid-type bypass flow control valve 31.

Further, the exhaust port 7 is connected in succession with an exhaust manifold 17 and an exhaust pipe 18.

The exhaust manifold 11 has mounted, near the connection end with the intake ports, fuel injection valves 20. The fuel injection valves 20 are supplied with liquid fuel, such as gasoline, stored in a fuel tank 21 by a fuel pump 22 via fuel supply pipes 23.

The throttle body 13 is provided with a throttle valve 24 for controlling the amount of intake air. This throttle valve 24 is driven in accordance with the depression of an accelerator pedal 25.

The air flow meter 15 detects the amount of flow of air in the engine intake system and outputs a signal corresponding to the same to a control apparatus 50.

The distributor 27 has built into it a rotational speed sensor 29 for detecting its rotational speed and rotational phase, i.e., the engine rotational speed and the crank angle. The signal generated by the same is input to a control apparatus 50. An exhaust gas recirculation (EGR) passage 34 connects an exhaust branching pipe 35 and a surge tank 38. A duty control type exhaust gas recirculation valve 32 changes the area of the EGR passage in accordance with electric pulses. The exhaust gas recirculation valve 32 is controlled by a control circuit 50.

Figure 2:
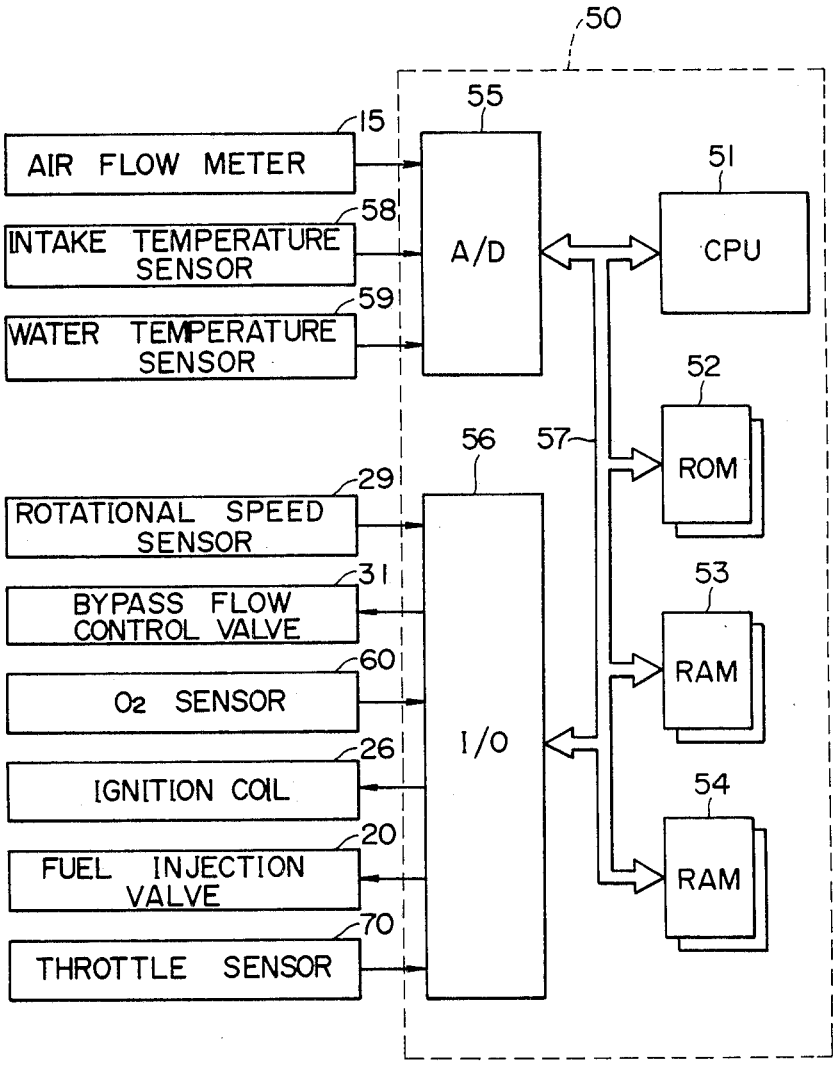
FIG. 2 is a block diagram of the control circuit of FIG. 1.

The control circuit 50 may be a microcomputer, an example of which is shown in FIG. 2. This microcomputer has a central processing unit (CPU) 51, a read only memory (ROM) 52, a random access memory (RAM) 52, a backup random access memory (RAM) 54 for holding the memory even after a power cessation, an A/D converter 55 having a multiplexer, and an I/O apparatus 56 having a buffer. These are mutually connected by a common bus 57. This microcomputer, as shown in FIG. 2, is supplied with current supplied by a battery power source 48 and is actuated by the same.

The A/D converter 55 receives as input an air flow signal generated by the air flow meter 15, an intake temperature signal generated by an intake temperature sensor 58, and a water temperature signal generated by a water temperature sensor 59. The A/D converter 55 converts this data, and outputs the same in accordance with instructions from the CPU 51 at predetermined timings to the CPU 51 and RAM 53 or 54. The I/O apparatus 56 receives as input an engine rotational speed signal and crank angle signal generated by the rotational speed sensor 29 and an air-fuel ratio signal generated by an $O_2$ sensor 60 and outputs this data in accordance with instructions of the CPU 51 at predetermined timings to the CPU 51 and RAM 53 or 54.

The CPU 51 calculates the fuel injection amount based on the data output by the sensors and outputs a signal based on the same via the I/O apparatus 56 to the fuel injection valves 20. Control over the amount of fuel supply in this case is effected by correcting a basic fuel amount found from the air flow detected by the air flow meter 15 and the engine rotational speed detected by the rotational speed sensor 29 in accordance with the intake temperature detected by the intake temperature sensor 58, the water temperature detected by the water temperature sensor 59, and the air-fuel ratio detected by the $O_2$ sensor 60.

Further, the CPU 51 outputs a bypass air signal via the I/O apparatus 56 to the bypass flow control valve 31 in accordance with the intake temperature detected by the intake temperature sensor 58 and water temperature detected by the water temperature sensor 59. The bypass flow control valve 31 is operated and controlled in its opening degree in accordance with the bypass air signal supplied from the I/O apparatus 56.

Further, the CPU 51 reads out from the ROM 52 the most appropriate ignition timing signal based on the basic fuel amount calculated by the same, the engine rotational speed and crank angle detected by the rotational speed sensor 29, and the intake temperature detected by the intake temperature sensor 58 and outputs the same from the I/O apparatus 56 to the ignition coil 26.

Figure 3:
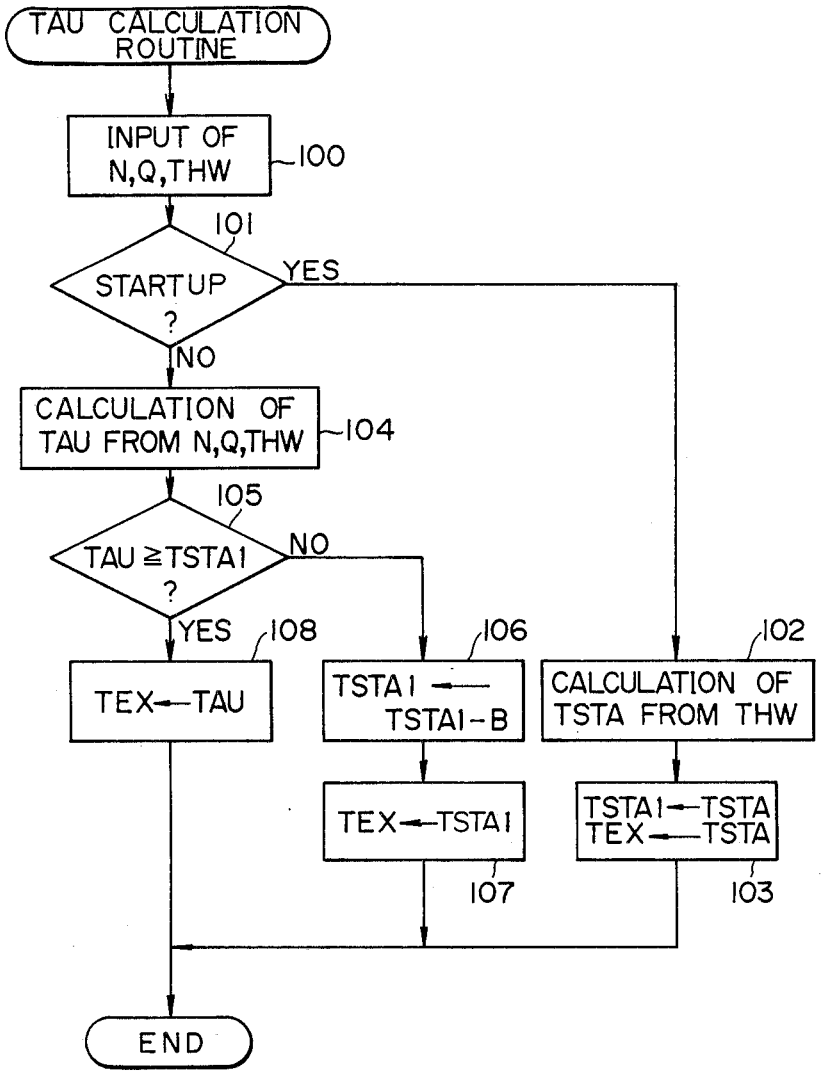
FIG. 3 is a flow chart showing a partial program of the control circuit of FIG. 2.

Next, an explanation will be given of the operation for control of the fuel supply of the present embodiment. FIG. 3 shows part of the routine for calculation of the fuel injection pulse width of the control apparatus 50. This routine is executed in the interrupt routine for each injection or midway of the main routine.

First, at step 100, the CPU 51 reads out the engine rotational speed N, the intake air flow Q, the coolant water temperature THW, and other input data from the RAM 53. At the next step 101, it is judged whether the engine is currently in a startup state. The method of judgement as to the startup state is, for example, to determine if the engine rotational speed is below a predetermined value from the idling speed, e.g., 500 rpm or less, or whether the start switch is ON.

If in the startup state, the routine advances to step 102 and the startup injection pulse width TSTA is found in accordance with the coolant water temperature THW at that time. A function table of THW-TSTA, for example, as shown in the following table, may be used to find TSTA in accordance with THW.

| THW | −40° C. | −20 | 0 | 20 | 40 | 60 | 80 |
|---|---|---|---|---|---|---|---|
| TSTA | 30 (msec) | 25 | 20 | 15 | 10 | 10 | 10 |

At the next step 103, the TSTA is stored for TSTA1, used in the processing of steps 105 to 107, and the executed injection pulse width TEX actually output to the injection valve side. With the above, the processing routine comes to an end.

On the other hand, if it is judged at step 101 that the engine is not in the startup state, then the routine advances to step 104 where the post-startup injection pulse width TAU is found from the intake air flow Q, rotational speed N, coolant water temperature THW, and the like at that time. As the method of calculation of TAU, for example, the following formula may be used:

$$TAU = Tp \times FWL \times (1 + ASEi)$$

Figure 4:
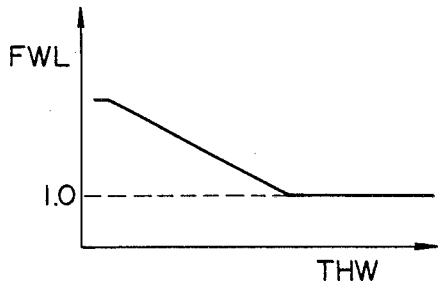
FIG. 4 is a graph of the THW-FWL function table.
Figure 5:
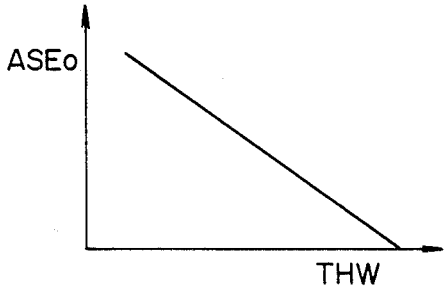
FIG. 5 is a graph of the HWW-ASEo function table.

Here, Tp is the basic injection pulse width, and if K is a constant, then Tp is calculated as Tp=K(Q/N). FWL is a coefficient of warmup increase and is found from a characteristic THW-FWL function table as shown in FIG. 4 in accordance with the coolant water temperature THW. ASEi is a coefficient of after-startup increase. ASEi is reduced bit by bit by a predetermined value A by a processing routine executed once per engine rotation. Specifically, ASEi is found from $ASEi = ASE_{i-1-A}$. However, the initial value ASEo is found from the characteristic THW-ASEo function table as shown in FIG. 5 in accordance with the coolant water temperature THW.

At step 105, it is judged whether the post-startup injection pulse width TAU is the startup injection pulse width TSTA1 or more. If TAU is less than TSTA1, then the routine advances to step 106 and attenuation processing is performed. Specifically, at step 106, TSTA1 is reduced bit by bit by a predetermined value B (TSTA1=TSTA1−B). Next, at step 107, this TSTA1 is stored in the executed injection pulse width TEX actually output to the injection valve side, whereupon the processing routine comes to an end.

On the other hand, if at step 105 it is judged that TAU≧TSTA1, then the routine advances to step 108, TAU is stored in the executed injection pulse width TEX, and then the processing routine comes to an end.

Figures 6, 7:
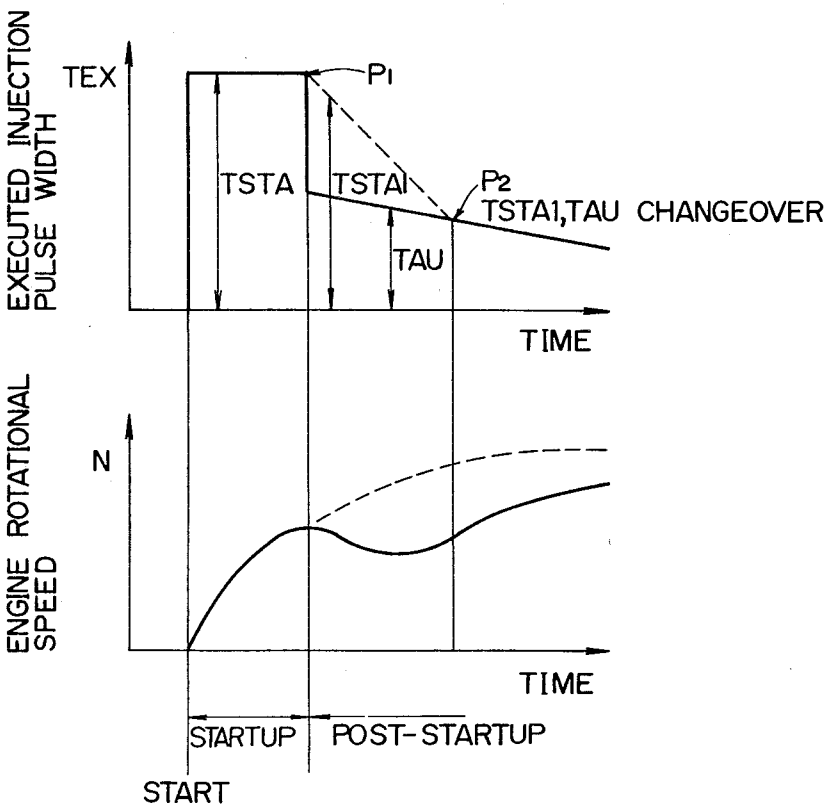
FIG. 6 and FIG. 7 are views for explaining the mode of operation and effect of the above-mentioned embodiment.

FIG. 6 and FIG. 7 are views for explaining the mode of operation and effects of the above-described embodiment.

In FIG. 6, the abscissa represents time, while the ordinate represents the executed injection pulse width TEX. At startup, TEX is equal to the startup injection TSTA. After startup, this is conventionally changed over to the post-startup injection TAU at $P_2$, as shown by the solid line, therefore the air-fuel ratio has been leaner than the demanded air-fuel ratio for several dozen revolutions directly after startup. As a result, as shown by the solid line in FIG. 7, the rotational speed has dropped, the starting characteristics have deteriorated, and, also, sudden torque shocks have been created. As opposed to this, in the present embodiment, after startup, as shown by the broken line TSTA1 in FIG. 6, TEX is gradually reduced until TAU and, after $P_2$, is controlled to be equal to TAU. As a result, no sudden changes occur in the air-fuel ratio directly after startup and the rotational speed rises smoothly with out drops, as shown by the broken line of FIG. 7. Of course, there are also no sudden changes in the torque.

Figure 8:
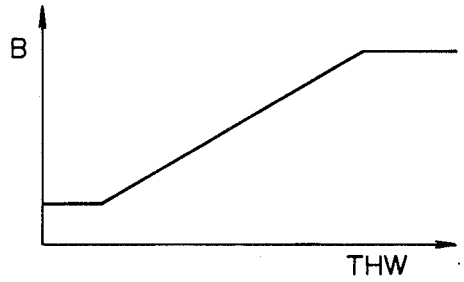
FIG. 8 is a graph of the THW-B function.
Figure 9:
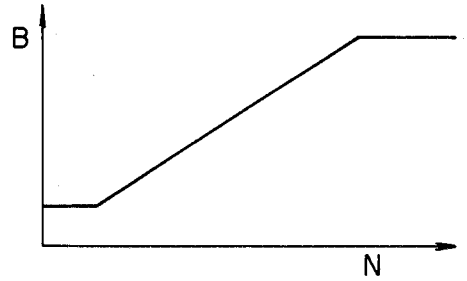
FIG. 9 is a graph of the N-B function.
Figure 10:
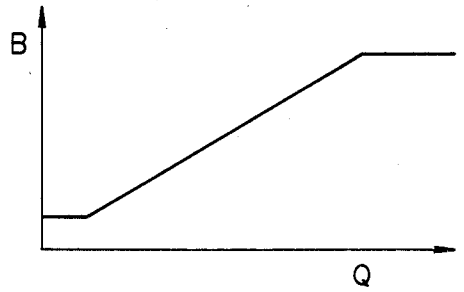
FIG. 10 is a graph of the Q-B function.
Figure 11:
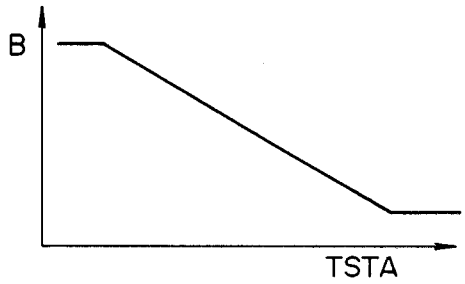
FIG. 11 is a graph of the TSTA-B function.

In the above-mentioned embodiment, the attenuation speed of TSTA1 was a value B set in advance. This B may also, however, be a value determined from a function of the coolant water temperature THW as shown in FIG. 8, a function of the rotational speed N as shown in FIG. 9, a function of the intake air flow Q as shown in FIG. 10, or a function of the startup injection pulse width TSTA as shown in FIG. 11. Further, B may also be a variable changing along with the elapse of time.

Since the fuel supply is gradually reduced directly after startup from the startup fuel supply amount to an after-startup fuel supply amount, the changeover from startup to after-startup running is effected extremely smoothly. As a result, it is possible to prevent the air-fuel ratio from changing sharply directly after startup, whereby the combustion directly after startup can be stabilized and startup characteristics improved. Further, it is possible to efficiently match the demanded air-fuel ratio directly after startup, whereby it is possible to reduce toxic exhaust gases. Still further, there are no sudden changes in the air-fuel ratio, therefore there are also no sudden changes in the torque and no unpleasant feeling due to torque shock is caused.

Many widely different embodiments of the present invention may be constructed without departing from the spirit and scope of the present invention. It should be understood that the present invention is not limited to the specific embodiments described in this specification, except as defined in the appended claims.

We claim:

1. A method for controlling the fuel supply of an internal combustion engine comprising the steps of:

detecting a state of the engine;

determining an amount of fuel supply for startup in accordance with the detected state of the engine;

supplying fuel to the engine by the determined amount for startup;

determining an amount TAU of fuel supply for after-startup in accordance with the detected state of the engine by $$TAU = T_p \times FWL \times (1 + ASE_i)$$

wherein $T_p$ is a base fuel injection amount dependent upon predetermined parameters of said engine, FWL is a coefficient of warmup dependent upon the temperature of the coolant, and $ASE_i$ is a coefficient of after-startup increase which is reduced gradually by predetermined crank angles of said engine;

supplying fuel to the engine by the determined amount for after-startup;

gradually decreasing the amount of fuel supply directly after engine startup from said determined startup fuel supply to said determined after-startup fuel supply, said step of gradually decreasing the amount of fuel supply including:

determining another coefficient ($ASE_2$) of after-startup in accordance with said amount TSTA of fuel supply for startup and said amount TAU of fuel supply for after start-up; and reducing said another coefficient of after-startup gradually by predetermined crank angles of said engine.

2. A fuel supply control apparatus for an internal combustion engine comprising:

means for detecting a state of the engine;

means for determining an amount of fuel supply for startup in accordance with the detected state of the engine;

means for determining an amount TAU of fuel supply for after-startup in accordance with the detected state of the engine by $$TAU = T_p \times FWL \times (1 + ASE_i)$$

wherein $T_p$ is a base fuel injection amount dependent upon predetermined parameters of said engine, FWL is a coefficient of warmup dependent upon the temperature of the coolant, and $ASE_i$ is a coefficient of after-startup increase which is reduced gradually by predetermined crank angles of said engine;

means for supplying fuel to the engine by the determined amount after-startup;

means for gradually decreasing the amount of fuel supply directly after engine startup from said determined startup fuel supply to said determined after-startup fuel supply, said gradual decreasing means including:

means for determining another coefficient ($ASE_2$) of after-startup in accordance with said amount TSTA of fuel supply for startup and said amount TAU of fuel supply for after-startup; and means for reducing said another coefficient of after-startup gradually by predetermined crank angles of said engine.

3. A method as claimed in claim 1, wherein said decreasing step includes a step of gradually decreasing the amount of fuel supply at a variable speed directly after engine startup from said determined startup fuel supply to said determined after-startup fuel supply, said variable speed depending upon said determined startup fuel supply.

4. A method as claimed in claim 3, wherein said variable speed is lower when the determined startup fuel supply is high than when the determined startup fuel supply is low.

5. An apparatus as claimed in claim 2, wherein said decreasing means includes means for gradually decreasing the amount of fuel supply at a variable speed directly after engine startup from said determined startup fuel supply to said determined after-startup fuel supply, said variable speed depending upon said determined startup fuel supply.

6. An apparatus as claimed in claim 5, wherein said variable speed is lower when the determined startup fuel supply is high than when the determined startup fuel supply is low.

* * * * *